United States Patent [19]

Huber et al.

[11] 4,290,818

[45] Sep. 22, 1981

[54] PROCESS FOR UTILIZING THE WASTE HEAT CONTENT OF CONDENSATE AND/OR VAPOR PRODUCED IN THE MANUFACTURE OF SUGAR

[76] Inventors: Herbert Huber, Waldseerstrasse 106, D6707 Schifferstadt; Hubert Schiweck, John-F. Kennedy-Strasse 5, D-6520 Worms, both of Fed. Rep. of Germany

[21] Appl. No.: 89,863

[22] Filed: Oct. 31, 1979

Related U.S. Application Data

[63] Continuation-in-part of Ser. No. 916,508, Jun. 19, 1978, abandoned.

[30] Foreign Application Priority Data

Jun. 28, 1977 [DE] Fed. Rep. of Germany ..... 2729192

[51] Int. Cl.[3] ..... C13D 3/00; C13G 1/00; C13F 1/00

[52] U.S. Cl. ..... 127/52; 127/42; 127/46 R; 127/61; 127/12; 127/9

[58] Field of Search ..... 127/42, 46 R, 48, 50, 127/9, 53, 58, 12, 61, 52; 203/26

[56] References Cited

U.S. PATENT DOCUMENTS 2,350,143 5/1944 Barber et al. ..... 127/50

2,391,843 12/1945 Rawlings ..... 127/50 X 4,016,001 4/1977 Hoks ..... 127/61 X 4,119,436 10/1978 Bosnjak ..... 203/26

OTHER PUBLICATIONS

Kirk-Othmer Ency. of Chem. Tech., vol. 19, pp. 203-219.

*Primary Examiner*—Michael S. Marcus

*Attorney, Agent, or Firm*—Armstrong, Nikaido, Marmelstein & Kubovcik

[57] ABSTRACT

A process is provided for utilizing the waste heat content of condensate and/or vapor produced in the manufacture of sugar in which thin juice is cooled, subjected to one or more stages of flash evaporation to concentrate and further cool the juice, after which it is heated with condensate and/or vapor produced elsewhere in the sugar manufacturing process and with incoming thin juice thereby heating the outgoing juice to substantially its original temperature and providing the cooling of the incoming thin juice. In another embodiment completely purified thin juice is concentrated in a multiple effect evaporating plant wherein the vapor produced in the final evaporator is compressed and is returned selectively to one of the preceding evaporators of the evaporating plant for use in heating the juice.

6 Claims, 2 Drawing Figures

PROCESS FOR UTILIZING THE WASTE HEAT CONTENT OF CONDENSATE AND/OR VAPOR PRODUCED IN THE MANUFACTURE OF SUGAR

This is a continuation-in-part application of application Ser. No. 916,508 filed June 19, 1978 now abandoned.

BACKGROUND OF THE INVENTION

1. Field of the Invention

This invention relates to a process for utilizing the heat content of condensate and/or vapour produced in the manufacture of sugar.

2. Description of the Prior Art

As is known, in the processing of 1 ton of sugar beets, about 1 ton of condensate is obtained from the second and succeeding evaporators of the multiple effect evaporating plant for the concentration of the juice from the vacuum pans for boiling and crystallizing the juice and from the preheaters for preheating the juice. The condensate thus produced has merely been flash evaporated to the end point of the final evaporator of the evaporating plant (about 1 bar, 100° C.) (see ULLMANNS Encyklopädie der technischen Chemie, 3rd Edition, Volume 19, page 239) and partially used for the heating of raw and preliming juice and of fresh extraction water. Nevertheless, even with optimum utilization of heat, to each ton of processed sugar beets, 0.4 to 0.6 ton of condensate at a temperature of 60°-70° C. leave the factory as unutilized effluent.

Depending upon the boiling scheme applied in a particular sugar factory, there are produced in the crystallization by the boiling plant, 250 to 300 kg of superheated vapour at a pressure of 0.2 to 0.25 bar and a temperature of 60°-70° C. per ton of processed beets, which must predominantly be condensed with cold water and thereafter introduced into the drainage system as so-called condenser water or cooled by means of a re-cooling circuit. To a small extent, vapour produced by boiling is also used for preheating raw and preliming juice, as well as fresh extraction water.

In all, in the procedure presently employed in a German sugar factory, about 800,000 kJ per ton of processed beets are lost as waste heat in condensates and vapour.

In addition, in Germany, the condensates and vapours produced in a sugar factory must now be cooled at considerable cost before they can be discharged as effluent because of anti-pollution laws.

OBJECTS OF THE INVENTION

It is an object of the present invention to provide a process which improves the energy economy in the manufacture of sugar.

It is a further object of the present invention to provide a process for the manufacture of sugar, which process results in less pollution being created.

SUMMARY OF THE INVENTION

According to one aspect of the present invention there is provided a process for utilizing the waste heat content of condensate and/or vapour produced in the manufacture of sugar during the purification and the concentration of sugar-containing juice. The process comprises the steps of:

(a) cooling the thin juice obtained by the filtration of juice from the first carbonation stage of a process for manufacturing sugar;

(b) subjecting the cooled thin juice to one or more stages of flash evaporation to concentrate and further cool the juice;

(c) heating the initially concentrated juice with condensate and/or vapour produced elsewhere in the sugar manufacturing process; and (d) heating the concentrated juice to substantially the original temperature of said thin juice by means of the thin juice, thereby cooling the latter.

According to a second aspect of the present invention there is provided a process for utilizing the waste heat content of vapour produced in the manufacture of sugar from a final evaporator of a multiple effect evaporating plant for concentrating sugar-containing juice, which process comprises the steps of:

(a) introducing the thin juice obtained by the filtration of the juice from the second carbonation stage of a process for manufacturing sugar into a first evaporator of a multiple effect evaporating plant to produce a partially concentrated juice;

(b) passing the partially concentrated juice through at least one intermediate evaporator of the evaporating plant to concentrate the juice further;

(c) introducing the juice into the final evaporator to produce juice concentrated to a required degree and to produce a vapour; and (d) compressing the vapour from the final evaporator and selectively returning the compressed vapour to one of the preceding evaporators of the evaporating plant for use in heating the juice.

According to a third aspect of the present invention there is provided a process for utilizing the waste heat content of condensate and vapour produced in the manufacture of sugar during the purification and the concentration of sugar-containing juice, which process comprises the steps of:

(a) cooling the thin juice obtained by the filtration of juice from a first carbonation stage of a process for manufacturing sugar;

(b) subjecting the cooled thin juice to one or more stages of flash evaporation to concentrate initially and further cool the juice;

(c) heating the initially concentrated juice with condensate and/or vapour produced elsewhere in the sugar manufacturing process;

(d) heating further the initially concentrated juice to substantially the original temperature of said thin juice by means of the thin juice, thereby cooling the latter;

(e) subjecting the juice obtained in (d) to a second carbonation stage in the process for manufacturing sugar;

(f) introducing the thin juice from the second carbonation into a first evaporator of a multiple effect evaporating plant to produce a partially concentrated juice;

(g) passing the partially concentrated juice through at least one other evaporator of the evaporating plant to concentrate the juice further;

(h) introducing the juice into a final evaporator of the evaporating plant to produce juice concentrated to a required degree and to produce a vapour; and (i) compressing the vapour from the final evaporator and selectively returning the compressed vapour to one of the preceding evaporators of the evaporating plant for use in heating the juice.

DESCRIPTION OF PREFERRED EMBODIMENTS

The invention is described in further detail below in conjunction, with various preferred embodiments. In the following description the terminology "thin juice" is employed conventionally to refer to the juice obtained by extraction from raw material (sugar beet, sugar cane or others) after separation of non-sugar substances following the first carbonation and filtration in a conventional sugar manufacturing process. The terminology, of course, also includes the completely purified filtrated thin juice obtained following the second carbonation.

Figure 1:
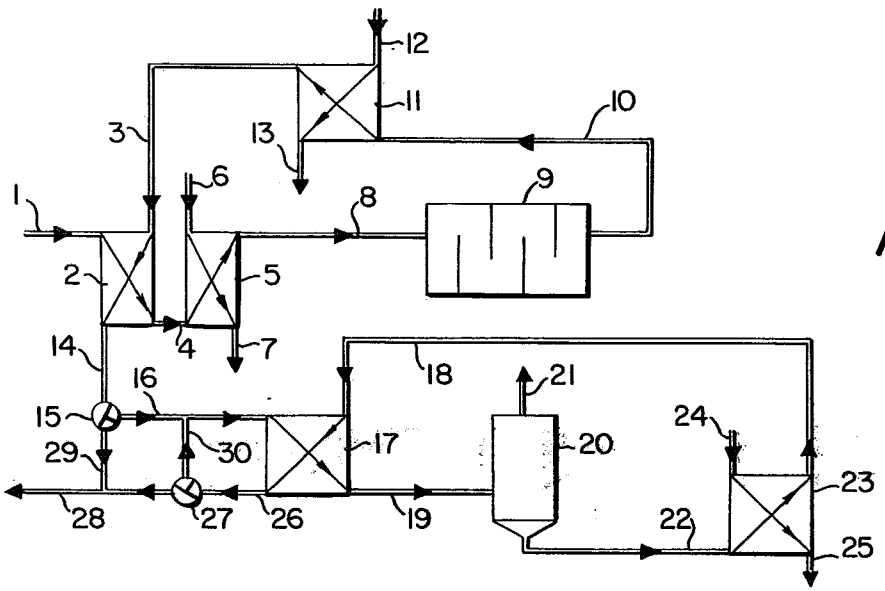
FIG. 1 shows by way of example a flow diagram of a process according to the first aspect of the present invention.

Referring now to FIG. 1, thin juice obtained after filtration of juice from the first carbonation and having a pH value of >11, for example, at 80°-90° C. is supplied through a duct 1 and first takes up heat in a heat exchanger 2 in exchange with hotter thin juice fed to the heat exchanger 2 by way of a duct 3. The thin juice is heated to the maximum possible extent in countercurrent flow with the hotter thin juice. Thereafter, the heated thin juice flows through a duct 4 to a further heat exchanger 5 in which heating to 110°-125° C. takes place. For this purpose, the heat exchanger 5 is heated by steam and/or vapour supplied by way of a duct 6, the condensate formed being fed by way of a duct 7 to a condensate collector. The thin juice thus heated up in the heat exchanger 5 then flows, by way of a duct 8, through a reaction vessel 9 in the form of a tubular reactor, in which complete glutamine and asparagine hydrolysis takes place, with a residence time of 10 to 20 minutes. The thin juice thus treated is cooled to the extent necessary, i.e., to a temperature not less than 96° C., for the subsequent process by passing the juice through a duct 10 to a heat exchanger 11, in heat exchange with cooler thin juice obtained, for example, to heat filtrated thin juice from second carbonation before entering the multiple effect evaporation plant which is used later in the process for concentrating the juice and which is fed to the heat exchanger 11 by way of a duct 12, in order to recover the heat supplied through the duct 10 and the heat exchanger 5 by means of vapour, to form a preheated thin juice which leaves the heat exchanger 11 by way of the outgoing duct 13. Instead of the heat exchanger 11, there may be provided a steam converter to which condensate is fed for vaporization.

As already mentioned, thin juice which is still hot flows through the duct 3 and the heat exchanger 2. The thin juice leaves the heat exchanger 2 by way of a duct 14 which is connected to a three-way valve 15. When all the thin juice is to be subjected to the subsequent flash evaporation, the valve 15 is so connected that the whole of the thin juice from the duct 14, which is still at a temperature of not less than 96° C., must flow through a duct 16 and through a heat exchanger 17, in which it is cooled to about 60° C. in heat exchange with thin juice in a duct 18. From the heat exchanger 17, the thin juice is fed by way of a duct 19 to a flash drum 20 for the performance of the flash evaporation. The flash drum 20 is directly connected to a condenser by way of a duct 21. During the flash evaporation, a concentration of the thin juice takes place, the degree of which concentration depends upon the temperature gradient and upon the number of process stages provided. That is to say, the juice can be subjected to a flash evaporation a number of times if desired. Additionally, during the flash evaporation all the volatile ammonium salts and free ammonium hydroxide are distilled off, and consequently all the volatile ammonium ions are produced at one point of the sugar manufacturing process. Also, the flash evaporation may take place stepwise within a single stage of the process for technical reasons concerning cooling water and for other reasons.

The concentrated juice at a temperature of not more than 30° C., flows through a duct 22 leading away from the flash drum 20 and is reheated in a heat exchanger 23 by means of vapour produced by boiling and/or by condensate which is fed to the heat exchanger by way of a duct 24. Heating to about 60° C. takes place. The vapour and/or condensate is formed elsewhere in the process and the heat contained therein would otherwise go to waste. The cooled condensate from the duct 24 is expelled at 25. The juice heated up by the waste heat, i.e., the vapour or the condensate from the duct 24, flows through the duct 18 and passes, as previously mentioned, through the heat exchanger 17, which the thin juice leaves at a temperature of about 96° C. by way of a duct 26. From there, the thin juice is directed by way of a three-way valve 27 and a duct 28 to a conventional second carbonation stage (which will not be particularly described) for further processing.

When only part of the thin juice is to be subjected to the flash evaporation, the three-way valve 15 is so connected that part of the juice flows from the duct 14 by way of the duct 29 directly to the second carbonation stage. In some cases, however, it may be advantageous for part of the juice to be recycled through the flash evaporation system. In this case, the three-way valve 27 is so connected that some of the juice in the duct 26 is passed through a duct 30 and the heat exchanger 17 back into the flash evaporation circuit. In any case, the concentrated juice is fed through the duct 28 to the second carbonation stage for further treatment after the flash evaporation. The further purification of the juice takes place in the usual manner and will not be particularly described here.

It will therefore be appreciated that the waste heat of the sugar manufacturing process can now be entirely or substantially used for concentration purposes in the sugar manufacturing process, by first cooling thin juice to about 60° C. in countercurrent flow with thin juice which has already been subjected to flash evaporation and subsequently reheated, then subjecting the juice cooled to this temperature to flash evaporation, which further reduces the temperature of the juice to 30° C. or lower, in one or more process steps and thereby concentrating the juice, and reheating the cold thin juice thus obtained to about 60° C. in heat exchangers by means of condensate and/or vapour produced by boiling, the condensate and the said vapour being cooled to less than 30° C. in the heat exchangers. This reheated thin juice (at about 60° C.) is used to cool the incoming thin juice which has an initial temperature of about 90° C., and the reheated juice thereby itself becomes heated up to the original initial temperature. If the total quantity of thin juice is not sufficient to utilize the heat content of all the available condensates and vapour produced by boiling, a part of the thin juice may be recycled and thus concentrated a number of times by the flash evaporation.

It will be understood that the waste heat of the sugar manufacturing process is generally constituted by low pressure steam or other vapour or by condensed vapour or other liquid (referred to herein generally as "condensate"). Normally the condensates produced in the sugar manufacturing process have a temperature of 80°-100° C. Vapour produced by boiling has a temperature of only 60° C. Thus, the condensates are at a temperature which is insufficient to heat the incoming thin juice which is already at a temperature of 80°-90° C. It is therefore necessary to cool the thin juice in order to be able to use the waste heat available and then to reheat the thin juice without supplying additional heat to the process. Such cooling would not normally be contemplated. The thin juice is cooled prior to being subjected to flash evaporation because if the thin juice were subjected to flash evaporation directly and then heated according to the invention from about 20° C. to 60° C. with heat from condensate or vapour, the residual heating to the original temperature of the thin juice would have to be brought about by the use of outside heat (steam). The preliminary cooling of the thin juice and the heating of the thin juice which was subjected to flash evaporation by means of countercurrent heat exchange (in heat exchanger 17) avoids this problem.

Furthermore, according to this aspect of the invention, an alkaline thin juice (pH value >9) is subjected to a flash evaporation, and more than 10% (i.e., in a two-stage flash evaporation from 60° C. to 10° C. about 15% of water is evaporated) of the water present can thus be distilled over. The ammonium compounds present in the thin juice, such as ammonium hydrogen carbonate, ammonium carbonate and free ammonium hydroxide, also pass over into the distillate. In this way, the thin juice is freed from ammonium hydroxide and ammonium salts. This is particularly advantageous because it eliminates the need for removing these compounds elsewhere.

In the prior art procedures hitherto employed, these ammonium compounds are removed only in the evaporating plant, where they cause a lowering of the pH value in the juice and consequently result in chemcial changes in the juice, such as the formation of invert sugar, the formation of coloring substances and the like, as well as corrosion in the evaporators. Since, under the conditions of juice purification usually performed in the prior art (pH values, temperatures, residence times), only a 40-60% hydrolysis of the glutamine and asparagine present in the thin juice is achieved with formation of ammonium salts of these acids and the remainder of the hydrolysis only takes place in the first stage of the evaporating plant, the process illustrated in the flow diagram is advantageous in that a complete hydrolysis of the glutamine and asparagine present in the thin juice can be accomplished. The glutamine and asparagine hydrolysis may be advantageously performed according to the invention by the method described below.

Thin juice having a pH value of >11 heated in countercurrent exchange (heat exchanger 5) from 80°-90° C. to 110°-125° C. is pumped at this temperature under pressure through a reaction vessel in the form of the tubular reactor 9 with a residence time of 10 to 20 minutes, and is then re-cooled in countercurrent to ≧96° C. in exchange with thin juice. Under the given reaction conditions, which depend somewhat on the glutamine and asparagine content of the juice, complete glutamine and asparagine hydrolysis takes place. To establish the heat balance, heat is already withdrawn from the juice after the reaction vessel by means of a preheater, suitably for the heating of the thin juice, and/or by means of a steam converter and this heat is fed back into the manufacturing process. The thin juice treated in this manner is then subjected to flash evaporation whereby all volatile ammonium salts and free ammonium hydroxide are distilled off. Consequently all the volatile ammonium ions are produced at one point of the manufacturing process.

By the combination of these steps one obtains not only a thermostable juice which can be concentrated in the individual stages during the later concentration of the thin juice in the evaporating plant without chemical modifications and hence without variations of the pH value, and which consequently no longer causes corrosion of the evaporators, but the condensates formed in the individual stages of the evaporating plant are substantially free from ammonium ions and can thus be directly employed as industrially useful water, for example, as fresh extraction water. In this way it is possible to avoid having to neutralize the ammonium hydroxide by addition of acid as has hitherto been usual, or by removing the ammonium ions by means of cation exchangers of the H-type.

Figure 2:
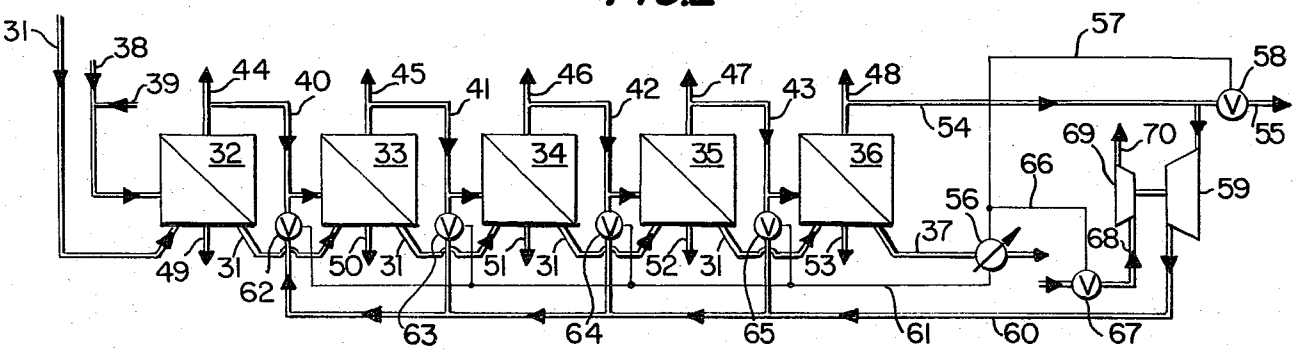
FIG. 2 shows by way of example a flow diagram of a process according to the second aspect of the present invention.

Referring to FIG. 2, completely purified filtrated thin juice after the second carbonation which has been preheated to the process temperature is fed in the course of the further sugar manufacturing process by way of a duct 31 to a multiple effect evaporating plant which is formed in the illustrated flow diagram of five evaporators 32, 33, 34, 35, 36. At the end of the final evaporating stage, the juice in duct 37 should have a density of 65°-70° Brix. The flow of steam in the evaporating plant is preferably parallel to the direction of the juice (duct 31), the steam flowing by way of ducts 38, 39. Full advantage is taken of the economic multiple utilization of the steam in this operation, that is to way, the vapour formed in the first stage 32 by the evaporation process flows through duct 40 and heats a second stage 33, the vapour from the second stage flows through duct 41 and heats a third stage 34, the vapour from the third stage flows through a duct 42 and heats a fourth stage 35 and the vapour from the fourth stage flows through a duct 43 and heats a fifth stage 36. In addition, the individual stages each supply vapour via the duct connections 44, 45, 46, 47, 48 respectively for heat-consuming units outside the evaporating plant, for example, to the duct 6. The condensates formed in the individual evaporators are fed through a duct 49 to a boiler house and through ducts 50, 51, 52 and 53 to a condensate collector (not shown).

An adequate thickening of the juice leaving the end of the final stage 36 by way of a duct 37 is a pre-requisite for satisfactory subsequent work in the sugar factory. If the juice is insufficiently thickened, vapour will often be passed from the final stage 36 through ducts 54 and 55 to a condenser (not shown), because this is more economical than passing thinner juice through the duct 37 into the subsequent crystallization process (not shown). However, this procedure involves the loss of considerable quantities of heat. In order to keep the density of the juice constant, there is provided in the duct 37 a pulse generator and density meter 56, which acts by way of a control line 57 on a regulating valve 58 in a duct 54, and opens or closes the valve 58 depending upon the density of the juice. In order to reduce the heat losses along duct 55 due to the condensation, vapour in the duct 54 is cut off from the condenser by the regulating valve 58 and is directed to a vapour compressor 59 which preferably returns the vapour after compression, as valuable heating vapour, by way of a duct 60, to the second stage 33 or, alternatively, to the stages 34, 35 or 36 subsequent to the second stage. Since vapour compressors have, by virtue of their design, only a regulating range between 70% and 100% of maximum capacity, fluctuations in the density of the juice cannot be completely eliminated if the return takes place, for example, only into the second stage 33.

Therefore, the performance of the vapour compressor 59 is first made such that, on return of the vapour through the duct 60 to the second stage 33, the regulating range of the vapour compressor 59 is fully sufficient to maintain the juice in the duct 37 at an optimum concentration. Thus, under the control of the density meter 56, by way of a control line 61, a valve 62 is opened, while the valves 63, 64, 65 are closed. The density meter 56 opens or closes by way of a further control line 66 a regulating valve 67 which, depending upon the extent to which it is open, passes more or less high-pressure steam through a duct 68 to a driving turbine 69 for the vapour compressor 59. In this way, the performance of the vapour compressor 59 is controlled and the density of the thick juice in the duct 37 is brought to its desired optimum level. The waste steam flowing away from the driving turbine 69 through a duct 70 is admixed with the steam in the duct 38 before the first stage 32 of the evaporating plant. Alternatively, an electrical driving unit may be employed for the vapour compressor 59.

Hitherto, if the juice has been insufficiently concentrated in the evaporating plant, vapours have been condensed by condensation with water, whereby a reduced pressure has been produced in the last stage of the evaporating plant, and this had led to additional heat losses. Also, it has sometimes been regarded as desirable to add vapours during the condensation in order to maintain the density of the thick juice constant (70% dry substance), which would otherwise fluctuate owing to varying removal of vapour for boiling and for preheating purposes. Therefore, the elimination of these heat losses in the evaporating plant by the use of a mechanical vapour compressor (heat pump) also reduces waste heat. The vapour compressor takes up the vapours which usually are condensed, compresses them and returns them to one of the preceding stages of the evaporating plant. In this way, not only are heat losses avoided, but also the density of the thick juice is maintained constant by means of control loops, which affords considerable advantages for the subsequent work in the sugar factory.

Mechanical vapour compressors have, due to their construction, only a range of regulation between 70% and 100% of maximum capacity. If, for example, in the case of a five-stage evaporating plant, the vapour compressor is so designed that, for example, the maximum concentration is obtained in the sugar manufacturing process with a compression of vapour from the fifth stage to the second stage of the evaporating plant, then the desired thick juice density is obtained only in this state of operation. When the state of operation changes, however, the system becomes nonelastic and is no longer controllable. Surprisingly, it has been found that, if the possibility is afforded of adding the compressed vapour also to the stages succeeding the second stage, that is to say, to the third and fourth stages, the range of regulation of the compressor is widened to 17.5–100% of maximum capacity owing to the multiple evaporation effect of the evaporating plant. In this way, it is possible to effect a completely automatic control of the evaporating plant, which results in an improvement in the uniformity of the operations and hence in a positive additional saving of heat.

The manner of operation is as follows: the valve 62 is opened, while the valves 63, 64, 65 are closed. The vapour compressor 59 is in operation. The pulse generator 56 monitors the density of the juice in the duct 37 and when the juice is too thick, the valve 62 is closed and the valve 63 is opened. If the density of the juice rises further, the valve 63 is closed and the valve 64 is opened. In the extreme case of very high juice density, the valve 64 is closed and the valve 65 is opened. In this way, the evaporating plant is fully automatically controlled. Fluctuations in the density of the juice no longer occur and optimum operation of the evaporating plant from the thermal viewpoint is established for each state of operation with minimum expenditure of energy for the operation of the vapour compressor 59.

The described process also has the advantage that it may now be useful to draw off a greater amount of raw juice during the extraction of sugar from the raw materials, whereby it is possible to increase the sugar yield without having to accept disadvantages in regard to heat economy. The process according to the invention also renders possible an increase in the processing performance of a sugar factory without the evaporating plant from which the vapours are derived for the preheating and the crystallization having to be enlarged, because less water has to be evaporated in the evaporating plant due to the preceding flash evaporation.

What is claimed is:

1. A process for utilizing the waste heat content of condensate and vapour produced in the manufacture of sugar during the purification and the concentration of sugar-containing juice, which process comprises the steps of:

(a) cooling an initial first thin juice obtained by the filtration of juice from the first carbonation stage of a process for manufacturing sugar to produce a cooled first thin juice;

(b) subjecting the cooled first thin juice to one or more stages of flash evaporation to concentrate and further cool the juice to produce a concentrated first thin juice;

(c) heating the concentrated first thin juice in two stages to substantially the original temperature of said initial first thin juice by means of, in the first stage, condensate and/or vapour produced elsewhere in the sugar manufacturing process and, in the second stage, said initial first thin juice, thereby cooling the latter;

(d) subjecting the juice obtained in (c) to a second carbonation stage to obtain an initial second thin juice;

(e) introducing the initial second thin juice from the second carbonation stage into a first evaporator of a multiple effect evaporating plant to produce a partially concentrated second thin juice;

(f) passing the partially concentrated second thin juice through at least one other evaporator of the evaporating plant to concentrate the juice further;

(g) introducing the juice from step (f) into a final evaporator of the evaporating plant to produce juice concentrated to a required degree and to produce a vapour; and (h) compressing the vapour from the final evaporator and selectively returning the compressed vapour to one of the preceding evaporators of the evaporating plant for use in heating the juice being concentrated therein.

2. A process according to claim 1, wherein only a part of the thin juice from the first carbonation stage is subjected to the one or more stages of flash evaporation in step (b).

3. The process according to claim 1, wherein the flash evaporation (b) and reheating (c) of the thin juice is carried out by recycling the juice and that part of the juice leaving the recycle is reheated in counter current with incoming thin juice to its original temperature.

4. A process according to claim 1, wherein prior to the cooling step (a) the thin juice is treated to hydrolyze completely the glutamine and asparagine present in the thin juice.

5. A process according to claim 1, wherein the compressed vapour from the last evaporator is selectively returned to a particular one of the preceding evaporators in dependence upon the density of the juice.

6. A process for utilizing the waste heat content of condensate and/or vapour produced in the manufacture of sugar during the purification and the concentration of sugar-containing juice, which process comprises the steps of:

(a) cooling an initial thin juice obtained by the filtration of juice from the first carbonation stage of a process for manufacturing sugar to produce a cooled thin juice;

(b) subjecting the cooled thin juice to one or more stages of flash evaporation to concentrate and further cool the juice to produce a concentrated thin juice;

(c) heating the concentrated thin juice in two stages to substantially the original temperature of the initial thin juice by means of, in the first stage, condensate and or vapour produced elsewhere in the sugar manufacturing process and, in the second stage, said initial thin juice, thereby cooling the latter.

* * * * *